US005711156A

United States Patent [19]

Matsui et al.

[11] Patent Number: 5,711,156

[45] Date of Patent: Jan. 27, 1998

[54] MULTISTAGE TYPE PULSE TUBE REFRIGERATOR

[75] Inventors: Takayuki Matsui; Tatsuo Inoue, both of Anjyo, Japan

[73] Assignee: Aisin Seiki Kabushiki Kaisha, Kariya, Japan

[21] Appl. No.: 645,151

[22] Filed: May 13, 1996

[30] Foreign Application Priority Data

May 12, 1995 [JP] Japan ..... 7-114886
Mar. 27, 1996 [JP] Japan ..... 8-070796

[51] Int. Cl.[6] ..... F25B 9/00

[52] U.S. Cl. ..... 62/6; 62/467

[58] Field of Search ..... 62/6, 467

[56] References Cited

U.S. PATENT DOCUMENTS

| | | | |
|---|---|---|---|
| 3,817,044 | 6/1974 | Daniels | 62/6 |
| 5,107,683 | 4/1992 | Chan et al. | 62/6 |
| 5,275,002 | 1/1994 | Inoue et al. | 62/6 |
| 5,335,505 | 8/1994 | Ohtani et al. | 62/6 |
| 5,412,952 | 5/1995 | Ohtami et al. | 62/6 |
| 5,515,685 | 5/1996 | Yanai et al. | 62/6 |
| 5,522,223 | 6/1996 | Yanai et al. | 62/6 |

OTHER PUBLICATIONS

W.E. Gifford et al., "Pulse Tube Refrigeration Progress", ASME Paper No. 63–WA–290, 1963, pp. 69–79.

R.G. Ross, Jr., "Cryocoolers 8", Proceedings of the 8th International Cryocooler Conference, Jun. 28–30, 1994, pp. 345–352.

C. Rizzuto et al., editors, Proceedings of the 15th International Cryogenic Engineering Conference, Genova, Italy, Jun. 7–10, 1994, *Cryogenics*, vol. 34, ICEC Supplement 1994, pp. 159–162.

*Primary Examiner*—Christopher Kilner

*Attorney, Agent, or Firm*—Burns, Doane, Swecker & Mathis, LLP

[57] ABSTRACT

A multistage type tube refrigerator comprising a regenerator-side pressure oscillation generator, first regenerator connected to the regenerator-side pressure oscillation generator, first cold head connected to the low temperature side of the first regenerator, a first pulse tube having one end connected to the first cold head and the other end connected by way of a first flow regulating mechanism to a first pulse tube-side phase shifter, second regenerator having one end connected to the first cold head and the other end connected to the second cold head, a second pulse having one end connected to the second cold head and the other end connected to second pulse tube-side phase shifter by way of second flow regulating mechanism, in which the first pulse tube-side phase shifter and the second pulse tube-side phase shifter are controlled independently of each other. Further, the pulse tube refrigerator operated while setting the phase angle of the pulse tube-side phase shifter to −50° to −120° relative to the regenerator-side pressure oscillation generator, while setting the phase angle of the second pulse tube-side phase shifter 15° to −90°.

7 Claims, 10 Drawing Sheets

MULTISTAGE TYPE PULSE TUBE REFRIGERATOR

BACKGROUND OF THE INVENTION

The present invention relates to a multistage pulse tube refrigerator and more particularly to a multistage type pulse tube refrigerator in which refrigerators and cold heads are connected alternately and serially in two or more stages.

A pulse tube refrigerator which has been proposed by W. E. Gifford et al. (see ASME paper No. 63-WA-290,1963) has been known as a refrigerator relatively simple in structure without using a movable mechanism and capable of achieving a temperature as low as 85.5.K. This type of pulse tube refrigerator comprises a pressure oscillation generator for reciprocating a working or working gas and a phase shifter for providing a phase difference between the reciprocation and the change of pressure of the working gas, thereby continuously conducting operations of taking up heat at one end and discharging heat at the other end continuously in a regenerator during reciprocation of the gas, to efficiently achieve a low temperature or refrigeration at the cold heads connected on one side of the regenerator.

By the way, for further improving the performance of the pulse tube refrigerator, a multistage type pulse tube refrigerator has been proposed recently. The multistage pulse tube refrigerator is to be explained with reference to FIG. 11.

In FIG. 11, a compressor 101 is connected at a gas exhaust port 102 with a high pressure-side tube or passage 103, and a high pressure opening/closing valve 104 is interposed to the top end of high pressure-side tube 103. Further, the compressor 101 is connected at the gas suction port 105 with a low pressure tube 106, and a low pressure opening/closing valve 107 for regenerator is interposed to the top end of low pressure tube 106. The high pressure opening/closing valve 104 for regenerator and low pressure opening/closing valve 107 for regenerator are controlled in an opening/closing manner by a regenerator-side valve control device 110 The compressor 101, the high pressure tube 103, the low pressure tube 106, the high pressure opening/closing valve 104 for regenerator, the low pressure opening/closing valve 107 for regenerator, and the regenerator-side valve control device 110 constitute a thermal regenerator-side pressure oscillation generator 111.

Both the high pressure opening/closing valve 104 for regenerator and the low pressure opening/closing valve 107 for regenerator are in communication through a conduit 108 with a first thermal regenerator 109. Lower temperature end 112 of a first regenerator 109 is connected to a first cold head 113, the first cold head 113 is further in communication with a first pulse tube 114, and the first pulse tube 114 is connected to the other end by way of a first flow regulating mechanism 118 to a pulse tube-side phase shifter 128.

The first cold head 113 is connected with the first regenerator 109, and is connected also with a second regenerator 115. The second regenerator 115 is further connected with a second cold head 116, the second cold head 116 is connected with a second pulse tube 117, and the second pulse tube 117 is connected at the other end by way of a second flow regulating mechanism 119 together with the first pulse tube 114 to the pulse tube-side phase shifter 128.

The pulse tube-side phase shifter 128 has the same constitution as the regenerator-side pressure oscillation generator 111. That is, a compressor 120 is connected at an exhaust port 121 of the working gas with a high pressure tube 122, and a high pressure opening/closing valve 123 for pulse tube is interposed to the top end of the high pressure tube 122. Further, the compressor 120 is connected at a suction port 124 of the working gas with a low pressure tube 125, and a low pressure opening/closing valve 126 for pulse tube is interposed to the top end of the low pressure tube 125. The high pressure opening/closing valve 123 for pulse tube and the low pressure opening/closing valve 126 for pulse tube are alternately controlled in opening/closing manner by a pulse tube-side valve control 127

Description is to be made for the operation of 2-stage type pulse tube refrigerator having the foregoing constitution.

At first, the pulse tube-side high pressure opening/closing valve 123 is opened, while the pulse tube-side low pressure opening/closing valve 126 is closed by the pulse tube-side valve control device 127. Then, a working gas at a high pressure passes from the exhaust port 121 of the compressor 120 through the high pressure tube 122 and further by way of the high pressure opening/closing valve 123 for pulse tube and first and second flow regulating mechanisms 118 and 119 and intrudes into the first pulse tube 114 and the second pulse tube 117. Subsequently with a slight time delay, the high pressure control valve 104 for regenerator is opened, while the low pressure opening/closing valve 107 for regenerator is closed by the regenerator-side valve control device 110. Then, the working gas at a high pressure passes from the exhaust 102 of the compressor 101 through the high pressure tube 103 and, further, by way of the high pressure opening/closing valve 104 for regenerator to reach the first regenerator 109. At a predetermined time after the high pressure state is attained in the pulse tube and the regenerator, the high pressure opening/closing valve 123 for pulse tube is closed, while the low pressure opening/closing valve 126 for pulse tube is opened by the pulse tube-valve control device 127. Then, the working gas at the high pressure in the first pulse tube 114 and the second pulse tube 117 passes the first and the second flow regulating mechanisms 118 and 119 respectively, enters by way of the low pressure opening/closing valve 126 for pulse tube into the low pressure tube 125 and is fed back to the suction port 124 of the compressor 120. Subsequently, at a slight time delay the high pressure opening/closing valve 104 for regenerator is closed, while the low pressure opening/closing valve 107 for regenerator is opened by the regenerator-side valve control device 110. Then, the working gas at high pressure in the first regenerator 109 enters by way of the low pressure opening/closing valve 107 for regenerator into low pressure tube 106 and is fed back to the suction port 105 of the compressor 101.

By repeating the above-mentioned operations continuously as one cycle, refrigeration can be achieved in the first cold head 113 and the second cold head 116.

Description is to be made for the principle of generating refrigeration in the pulse tube refrigerator.

The working gas in the first regenerator 109 conducts reciprocating operation by the opening/closing operation of the high pressure opening/closing valve 104 for regenerator and the low pressure opening/closing valve 107 for regenerator and opening/closing operation of the high pressure opening/closing valve 123 for pulse tube and the low pressure opening/closing valve 126 for pulse tube. In this case, since there is a slight delay of the opening/closing operation of the high pressure opening/closing valve 104 for regenerator relative to the pulse tube-side high pressure opening/closing valve 123, and the opening/closing operation of the low pressure opening/closing valve 107 for regenerator relative to the low pressure opening/closing valve 126 for pulse tube, a deviation is caused to the changing timing of the displacement change and the pressure change of the working gas in the first regenerator 109. Then, the working gas expands at one end during reciprocation to absorb heat from the periphery, moves to the other end and is compressed at that position to discharge heat to the periphery. By utilizing the behavior of the working gas, the heat in the vicinity of the first cold head 113 is carried into the regenerator-side pressure oscillation generator 111 to cool the first cold head 113 by controlling the opening/closing operation for each of the valves such that heat is absorbed when the working gas in the first generator 109 moves near the first cold head 113, while heat is released when the working gas moves remote from the first cold head 113.

Further, the second regenerator 115 is in a communication state with the first regenerator 109 by way of the first cold head 113. Accordingly, when the working gas near the first cold head 113 in the first regenerator 109 reciprocates, there is present a reciprocating flow that reciprocates from the first regenerator 109 by way of the first cold head 113 to the first pulse tube 114 and a reciprocating flow that reciprocates from the first regenerator 109 by way of the first cold head 113 to the second regenerator 115. Accordingly the flow rate of the working gas in the second regenerator 115 is smaller compared with the flow rate of the working gas in the first regenerator 109 and, correspondingly, the fluctuation amount of displacement of the working gas is discontinuous with and smaller than that of the working gas in the first regenerator 109. Further, the working gas in the second regenerator 115 has as deviation for the fluctuation timing of the displacement fluctuation and the pressure change of the working gas different from the working gas in the first regenerator 109 under the effect of the working gas flowing from the second pulse tube 117 by way of the second flow regulating mechanism 119. Accordingly, the displacement amount, and the fluctuation timing for the displacement change and the pressure change of the working gas in the second regenerator 115 is not continuous with the working gas in the first regenerator 109.

The deviation for the fluctuation timing of the displacement change and the pressure change of the working gas is generally referred to as a phase difference of the working gas. A phase angle of the working gas shows an amount of the phase difference quantitatively. The phase angle of the working gas is obtained by converting the ratio of the deviation amount to the displacement change and the pressure change for one period into an angle assuming the period as 360° in the periodical displacement change and the pressure change of the working gas. In the pulse tube refrigerator, it is considered that the phase angle of the working gas for providing refrigeration most efficiently is 90° near the cold head.

The phase angle of the working gas changes continuously in the regenerator. For example, the phase angle of the working gas in the first regenerator 109 increases from the vicinity of the regenerator-side pressure oscillation generator 111 to the low temperature end 112. Accordingly, it is possible to control the phase angle of the working gas near the first cold head 113 to about 90° by controlling the high/low pressure switching timing of the regenerator-side pressure oscillation generator 111 and the pulse tube-side phase shifter 128 by the pulse tube-side valve control device 127.

In a case where the phase angle of the working gas in the first regenerator 109 and the second regenerator 115 is continuous, if the phase angle is 90° near the first cold head 113, the phase angle of the working gas in the second regenerator 115 is not less than 90°, so that the phase angle of the working gas in the vicinity of the second cold head 116 can not be 90°. By the way, the phase angle of the working gas in the second regenerator 115 is not in continuous with the phase angle of the working gas in the first regenerator 109 for the reason described. Therefore, it is theoretically possible to decrease the phase angle at about 90° in the vicinity of the first cold head 113, and increase the phase angle to about 90° again in the vicinity of the second cold head 116 by controlling the high/low pressure switching timing for the regenerator-side pressure oscillation generator 111 and the pulse tube-side phase shifter 128.

With the principle of generating refrigeration as described above, not only can refrigeration be efficiently utilized in the first cold head 113 and the second cold head 116, but also extremely low refrigeration temperature can be attained in the second cold head 116 because both ends of the second regenerator 115 are connected with the cold heads by which the temperature of the working gas which was initially low is further decreased, heat carrying from the second pulse tube 117 is suppressed as much as possible since the displacement amount of the working gas in the second refrigerator 115 is small. Further, since there are a plurality of cold heads, a single device can be applied to a wide variety of uses.

The phase angle of the working gas near the cold head has an effect of high/low pressure switching timing by the regenerator-side pressure oscillation generator and the pulse tube-side pressure oscillation generator, as well as volume ratio between each of the pulse tubes, etc. Therefore, determination of the conditions for making the phase angles of the working gases near a plurality of cold heads to about 90° simultaneously is quite time consuming and difficult and there may be a case that no optimal condition can be found at all. In such a case, the multi-stage pulse tube refrigerator can not wholly utilize the merit of multistaging. Accordingly, it is a technical object of the present invention to provide a multistage pulse tube refrigerator capable of effectively utilizing the merit obtained by multistaging, having good refrigeration efficiency and capable of reaching further lower refrigeration temperature.

SUMMARY OF THE INVENTION

The present inventor has made earnest studies on existent multistage type pulse tube refrigerators and has found that it is difficult to control the phase angle of the working gas near the cold head to about 90° if the switching timings for high/low pressure of working gas reciprocating in a plurality of pulse tubes are identical with each other, and the present invention has been accomplished based on this finding.

The foregoing technical subject can be attained in accordance with the first aspect of the present invention in a multistage type pulse tube refrigerator wherein a plurality of regenerators and cold heads by the same number as the regenerators are connected alternately in series, each of the cold heads is connected with one end of each of pulse tubes respectively, the other end of each of the pulse tubes is connected with a pulse tube-side phase shifter, a regenerator that is disposed at one end, among the regenerators and the cold heads connected alternately in series, is connected with a regenerator-side pressure oscillation generator, in which the operation timing for each of the pulse tube-side phase shifter is controlled independently.

In accordance with the above technical means, the pulse tube-side pressure oscillation generator is connected to each of the pulse tubes and the operation timing for each of the pulse tube-side pressure oscillation generator mechanism is controlled independently. Accordingly, the phase angle of the working gas in the cold head can be set independently by the pulse tube-side pressure oscillation generator connected to each of the pulse tubes.

DESCRIPTION OF THE PREFERRED EMBODIMENTS

First Embodiment

Figure 1:
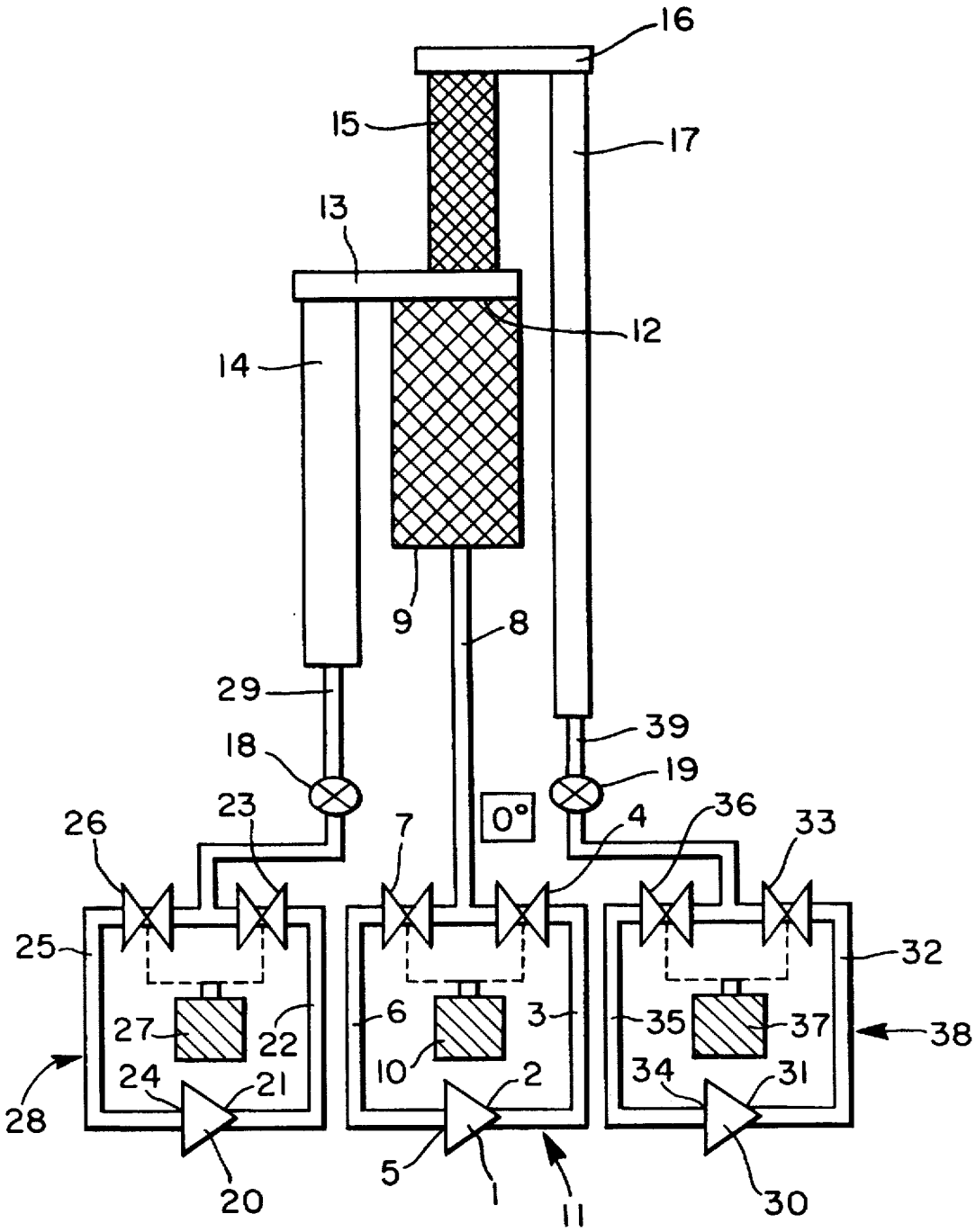
FIG. 1 is an entire view for a 2-stage pulse tube refrigerator in a first embodiment according to the present invention.

FIG. 1 shows the first embodiment of the present invention. In FIG. 1, a regenerator-side compressor 1 is connected on an exhaust side 2 of a working gas with a regenerator-side high pressure communication tube 3, and a high pressure opening/closing valve 4 for regenerator is interposed at the top end of the regenerator-side high pressure communication tube 3. Further, the regenerator-side compressor 1 is connected on a suction side 5 with a regenerator-side low pressure communication tube 6, and a low pressure opening/closing valve 7 for regenerator is interposed at the top end of the refrigerator-side low pressure communication tube 6. The high pressure opening/closing valve 4 for regenerator and the low pressure opening/closing valve 7 for regenerator are controlled in an opening/closing control way alternately to each other by a regenerator-side valve control device 10. The regenerator-side compressor 1, the regenerator-side high pressure communication tube 3, the regenerator-side low pressure communication tube 6, the high pressure opening/closing valve 4 for regenerator, the low pressure opening/closing valve 7 for regenerator and the regenerator-side valve control device 10 constitute a regenerator-side pressure oscillation generator 11.

The high pressure opening/closing valve 4 for the regenerator the low pressure opening/closing valve 7 for regenerator are both in communication with a first regenerator 9 by way of regenerator-side conduit 8.

Low temperature end 12 of the first regenerator 9 is connected with a first cold head 13, and the first cold head 13 is further in communication with a first pulse tube 14, and the first pulse tube 14 is connected at the other end by way of a first flow regulating mechanism 18 to a first pulse tube-side phase shifter 28.

The first cold head 13 is connected with the first regenerator 9, and is connected to a second regenerator 15. Second regenerator 15 is further connected to a second cold head 16, the second cold head 16 is connected with a second pulse tube 17, and the second pulse tube 17 is connected at the other end by way of a second flow regulating mechanism 19 to second pulse tube-side phase shifter 38.

The first pulse tube-side phase shifter 28 and second pulse tube-side phase shifter 38 have the same constitution as regenerator-side pressure oscillation generator 11. That is, in the first pulse tube-side phase shifter 28, the first pulse tube-side compressor 20 is connected on the exhaust side 21 to a first pulse tube-side high pressure communication tube 22, and a high pressure opening/closing valve 23 for first pulse tube is interposed at the top end of the first pulse tube-side high pressure communication tube 22. Further, the first pulse tube-side compressor 20 is connected on the suction side 24 of the working gas with a first pulse tube-side low pressure communication tube 25, and a low pressure opening/closing valve 26 for first pulse tube is interposed at the top end of the first pulse tube-side low pressure communication tube 25. High pressure opening/closing valve 23 for first pulse tube and low pressure opening/closing valve 26 for first pulse tube are controlled in an opening/closing way alternately with each other by a first pulse tube-side valve control device 27. Further, the high pressure opening/closing valve 23 for first pulse tube and the low pressure opening/closing valve 26 for a first pulse tube are connected by first pulse tube-side conduit 29 and the first flow regulating mechanism 18 to the first pulse tube 14. Further, in the second pulse tube-side pressure oscillation generator 38, a second pulse tube-side compressor 30 is connected on the exhaust side 31 of the working gas to a second pulse tube-side high pressure communication tube 31, and a high pressure opening/closing valve 33 for second pulse tube is interposed at the top end of a second pulse tube-side high pressure communication tube 32. Further, the second pulse tube-side compressor 30 is connected on the suction side 34 of the working gas with a second pulse tube-side low pressure communication tube 35, and a low pressure opening/closing valve 36 for second pulse tube is interposed at the top end of the second pulse tube-side low pressure communication tube 35. High pressure opening/closing valve 33 for second pulse tube and low pressure opening/closing valve 36 for second pulse tube are controlled in an opening/closing way alternately to each other by a second pulse tube-side valve control device 37. Further, the high pressure opening/closing valve 33 for second pulse tube and the low pressure opening/closing valve 36 for second pulse tube are connected by a second pulse tube-side conduit 39 to the second pulse tube 16.

The operation of the pulse tube refrigerator having the constitution as described is to be explained next.

At first, the high pressure opening/closing valve 23 for first pulse tube is opened and the low pressure opening/closing valve 26 for first pulse tube is closed by the first pulse tube-side valve control device 27. Then, a working gas at a high pressure passes from the exhaust side 21 of the first pulse tube-side compressor 20, passes through the first pulse tube-side high pressure communication tube 22, further passes by way of the high pressure opening/closing valve 23 for first pulse tube and first flow regulating mechanism 18 and intrudes from the first pulse tube-side conduit 29 into the first pulse tube 14. Further, the high pressure opening/closing valve 33 for second pulse tube is opened and the low pressure opening/closing valve 36 for second pulse tube is closed by the second pulse tube-side valve control device 37. Then, a working gas at a high pressure passes from the exhaust side 31 of the second pulse tube-side compressor 30 through the second pulse tube-side high pressure communication tube 32, further passes by way of high pressure opening/closing valve 33 for second pulse tube and second flow regulating mechanism 19 and intrudes from the second pulse tube-side conduit 39 into the second pulse tube 16. Subsequently, after a slight time delay, the high pressure opening/closing valve 4 for regenerator is opened and the low pressure opening/closing valve 7 for regenerator is closed by the regenerator-side valve control device 10. Then, a working gas at a high pressure passes from the exhaust side 2 of the compressor 1 to the high pressure tube 3 and further by way of the high pressure opening/closing valve 4 for regenerator and arrives from refrigerator-side conduit 8 to the regenerator 9. At a predetermined time after the pulse tube and the regenerator attain a high pressure state, the high pressure opening/closing valve 23 for first pulse tube is closed and the low pressure opening/closing valve 26 for first pulse tube is opened by the first pulse tube-side valve control device 27. Then, a working gas at a high pressure in the first pulse tube 14 passes from the first pulse tube-side conduit 29 through the first flow regulating mechanism 18 and by way of the low pressure opening/closing valve 26 for the first pulse tube into the first pulse tube-side low pressure communication tube 25 and is then fed back to suction side 24 of the first pulse tube-side compressor 20. Further, the high pressure/closing valve for second pulse tube 17 is closed and the low pressure opening/closing valve 36 for second pulse tube is opened by the second pulse tube-side valve control device 37. Then, a working gas at a high pressure in the second pulse tube 17 passes from the second pulse tube-side conduit 39 through the second flow regulating mechanism 19 and by way of the low pressure opening/closing valve 36 for second pulse tube, enters into the second pulse tube-side low pressure communication tube 35 and is then fed back to suction side of the second pulse tube side compressor 20. Subsequently, after a slight time delay, the high pressure opening/closing valve 4 for regenerator is closed and the low pressure opening/closing valve 7 for regenerator is opened by the regenerator-side valve control device 10. Then, a working gas at a high pressure in the regenerator 9 enters from the regenerator-side conduit 8 by way of the low pressure opening/closing valve 7 for regenerator into the regenerator-side low pressure communication tube 6 and is then fed back to the suction side 5 of the regenerator-side compressor 1.

By continuously repeating the foregoing operations as one cycle, refrigeration is generated by the first cold head 13 and second cold head 16.

Then, high/low pressure switching for the first pulse tube-side phase shifter 28 and the second pulse tube-side phase shifter 38 is controlled independently by the first pulse tube-side valve control device 27 and the second pulse tube-side valve control device 37 respectively. Accordingly, the phase angles of the working gas in the first cold head 13 and second cold head 16 can be controlled independently.

Second Embodiment

Figure 2:
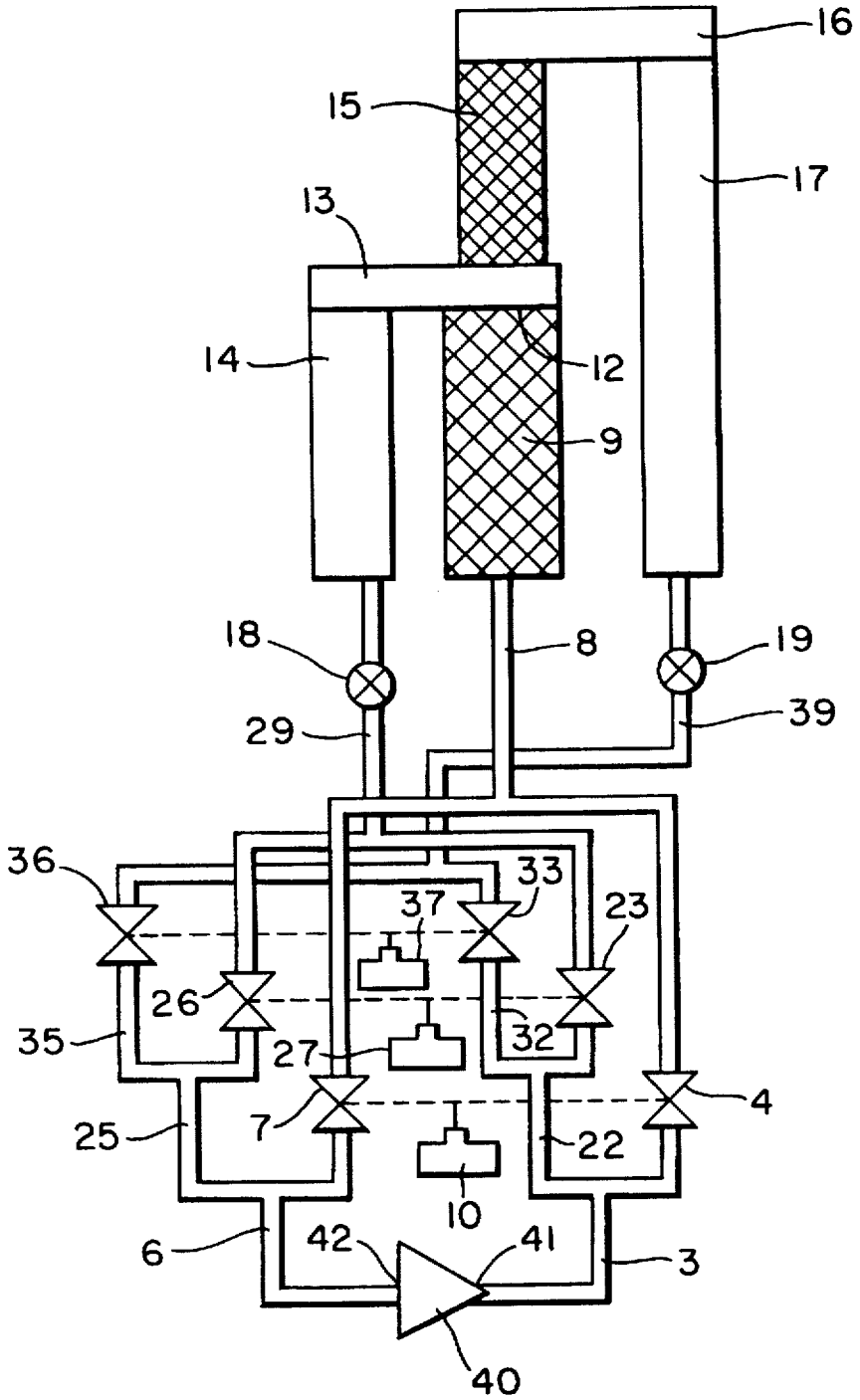
FIG. 2 is an entire view for a 2-stage pulse tube refrigerator in a second embodiment according to the present invention.

FIG. 2 shows a constitution of a pulse tube refrigerator illustrating a second embodiment according to the present invention.

In FIG. 2, a compressor 40 is connected on the exhaust side 41 with the regenerator-side high pressure communication tube 3. High pressure opening/closing valve 4 is disposed at the top end of the regenerator-side high pressure communication tube 3. The compressor 40 is in communication on the suction side 42 with the regenerator-side low pressure communication tube 6. The low pressure opening/closing valve 7 for regenerator is disposed at the top end of the regenerator-side low pressure communication tube 6. High pressure opening/closing valve 4 for regenerator and low pressure opening/closing valve 7 for regenerator are subjected to opening/closing control alternately with each other by the regenerator-side valve control device 10. Further, both the high pressure opening/closing valve 4 for regenerator and the low pressure opening/closing valve 7 for regenerator are connected by the regenerator-side conduit 8 to the first regenerator 9. The regenerator-side high pressure communication tube 3 is in communication with the first pulse tube-side high pressure communication tube 22 at the midway point between the compressor 40 and the high pressure opening/closing valve 4 for regenerator, and the high pressure opening/closing valve 23 for first pulse tube is disposed at the top end of the first pulse tube-side high pressure communication tube 22. Further, the refrigerator-side low pressure communication tube 6 is in communication with the first pulse tube-side low pressure communication tube 25 at the midway point between the compressor 40 and the low pressure opening/closing valve 7 for refrigerator, and the low pressure opening/closing valve 26 for first pulse tube is disposed at the top end of the first pulse tube-side low pressure communication tube 25. High pressure opening/closing valve 23 for first pulse tube and low pressure opening/closing valve 26 for first pulse tube are controlled in an opening/closing way alternately with each other by the first pulse tube-side valve control device 27. Further, both the high pressure opening/closing valve 23 for first pulse tube and the low pressure opening/closing valve 26 for first pulse tube are connected by the first pulse tube-side conduit 29 by way of the first flow regulating mechanism 18 to the first pulse tube 14. First pulse tube-side high pressure communication tube 22 is connected at the midway point thereof with the second pulse tube-side high pressure communication tube 32 and the high pressure opening/closing valve 33 for second pulse tube is disposed at the top end of the second pulse tube-side high pressure communication tube 32. Further, the first pulse tube-side low pressure communication tube 25 is connected at the midway point thereof with the second pulse tube-side low pressure communication tube 35, and the low pressure opening/closing valve 36 for second pulse tube is disposed at the top end of the low pressure communication tube 35 for second pulse tube. High pressure opening/closing valve 33 for second pulse tube and low pressure opening/closing valve 36 for second pulse tube are subjected to opening/closing control alternately with each other by second pulse tube-side valve control device 37. Further, the high pressure opening/closing valve 33 for second pulse tube and the low pressure opening/closing valve 36 for second pulse tube are in communication by the second pulse tube-side conduit 39 by way of the second flow regulating mechanism 19 with the second pulse tube 17. Low temperature end 12 of the first regenerator 9 is connected with the first cold head 13 and the first cold head 13 is further in communication with the other connection end of the first pulse tube 14 with the first pulse tube-side conduit 29. First cold head 13 is connected with the first regenerator 9 and is connected also to the second regenerator 15. The second regenerator 15 is further connected to the second cold head 16 and the second cold head is connected to the other connection end of the second pulse tube 17 with the second pulse tube-side conduit 39.

The operation is to be explained for the two-stage type pulse tube refrigerator having the constitution as described above.

At first, the high pressure opening/closing valve 23 for first pulse tube is opened and the low pressure opening/closing valve 26 for first pulse tube is closed by the first pulse tube-side valve control device 27. Then, a working gas at a high pressure passes from the exhaust side 41 of the compressor 40 through the high pressure regenerator-side communication tube 3, further passes through the first pulse tube-side high pressure communication tube 22 connected at the midway point and further passes through the high pressure opening/closing valve 23 for first pulse tube and intrudes from the first pulse tube-side conduit 29 into the first pulse tube 14. Further, the high pressure opening/closing valve 33 for second pulse tube is opened and the low pressure opening/closing valve 36 for second pulse tube is closed by the second pulse tube-side valve control device 37. Then, a working gas at a high pressure passes from the exhaust side 41 of the second pulse tube-side compressor 40 through the refrigerator-side high pressure communication tube 3, passes the first pulse tube-side high pressure communication tube 22 disposed at the midway and the second pulse tube-side high pressure communication tube 32 disposed further at the midway point and by way of the high pressure opening/closing valve 33 for second pulse tube and intrudes from the second pulse tube-side conduit 39 into the second pulse tube 16. Subsequently, after a slight time delay, the high pressure opening/closing valve 4 for regenerator is opened and the low pressure opening/closing valve 7 for regenerator is closed by the regenerator-side valve control device 10. Then, a working gas at a high pressure passes from the exhaust side 41 of the compressor 40 through the regenerator-side high pressure tube 3 and by way of the high pressure opening/closing valve 4 for regenerator and arrives from the regenerator-side conduit 8 to the regenerator 9. At a predetermined time after the pulse tube and the regenerator have attained a high pressure state, the high pressure opening/closing valve 23 for first pulse tube is closed and the low pressure opening/closing valve 26 for first pulse tube is opened by the first pulse tube-side valve control device 27. Then, a working gas at a high pressure in the first pulse tube 14 passes from the first pulse tube-side conduit 29 through the first flow regulating mechanism 18 and by way of the low pressure opening/closing valve 26 for first pulse tube into the first pulse tube-side low pressure communication tube 25 and is then fed back to the suction side 42 of the first pulse tube-side compressor 40. Further, the high pressure/closing valve 33 for second pulse tube is closed and the low pressure opening/closing valve 36 for second pulse tube is opened by the second pulse tube-side valve control device 37. Then, a working gas at a high pressure in the second pulse tube 16 passes from the second pulse tube-side conduit 39 through the second flow regulating mechanism 19 and by way of the low pressure opening/closing valve 36 for second pulse tube, enters the second pulse tube-side low pressure communication tube 35 and is then fed back to the suction side 42 of the compressor 40 passing though the first pulse tube-side low pressure communication tube 25 and the regenerator-side low pressure communication tube 6. Subsequently, after a slight time delay, the high pressure opening/closing valve 4 for regenerator is closed and the low pressure opening/closing valve 7 for regenerator is opened by the regenerator-side valve control device 10. Then, a working gas at a high pressure in the regenerator 9 enters from the regenerator-side conduit 8 by way of the low pressure opening/closing valve 7 for regenerator into the regenerator-side low pressure communication tube 6 and is then fed back to the suction side 42 of the compressor 40.

By continuously repeating the foregoing operations as one cycle, refrigeration is generated by the first cold head 13 and the second cold head 16.

In this embodiment, high/low pressure switching of the working gas between the first pulse tube-side conduit 29 and the first pulse tube 14 is controlled by the first pulse tube-side valve control device 27, high/low pressure switching of a working gas between the second pulse tube-side conduit 39 and the second pulse tube 17 is controlled by the second pulse tube-side valve control device 39, and high/low pressure switching of a working gas between the regenerator-side conduit 8 and the first regenerator 9 is controlled by the regenerator-side valve control device 10 respectively and independently. Accordingly, the phase angles of the working gas in the first cold head 13 and the second cold head 15 can be controlled independently.

Third Embodiment

Figure 3:
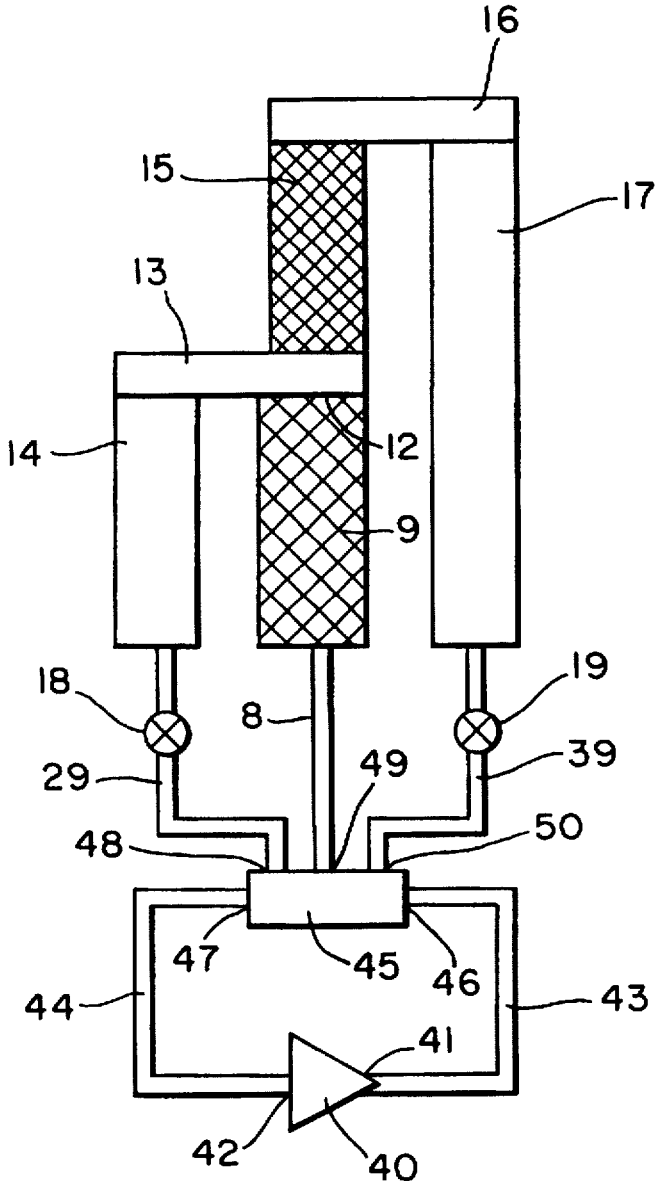
FIG. 3 is an entire view for a 2-stage pulse tube refrigerator in a third embodiment according to the present invention.

FIG. 3 is a view illustrating a third embodiment according to the present invention. In FIG. 3, the compressor 40 is in communication by way of a high pressure tube 43 connected with the exhaust side 41 thereof to a high pressure port 46 of a switching valve 45 and by way of a low pressure tube 44 connected to the suction side 42 with a low pressure port 47 of the switching valve 45. Further, the switching valve 45 has a first pulse tube-side port 48, a regenerator-side port 49 and a second pulp-side port 50. The first pulse tube-side port 48 is in communication through the first pulse tube-side conduit 29 by way of the first flow regulating mechanism 18 at the midway point with the first pulse tube 14, the regenerator-side port 49 is in communication through the regenerator-side conduit 8 with the first regenerator 9, and the second pulse tube-side port 50 is in communication through the second pulse tube-side conduit 39 by way of the second flow regulating mechanism 19 at the midway point with the second pulse tube 17. Low temperature end 12 of the first regenerator 9 is connected with the first cold head 13 and, the first cold head 13 is further in communication with the other connection end of the first pulse tube 14 with the first pulse tube-side conduit 29. The first cold head 13 is connected with the first regenerator 9 and is also connected with the second regenerator 15. The second regenerator 15 is further connected to the second cold head 16 and the second cold head 16 is connected to the other connection end of the second pulse tube 17 with the second pulse tube-side conduit 39.

Figure 4:
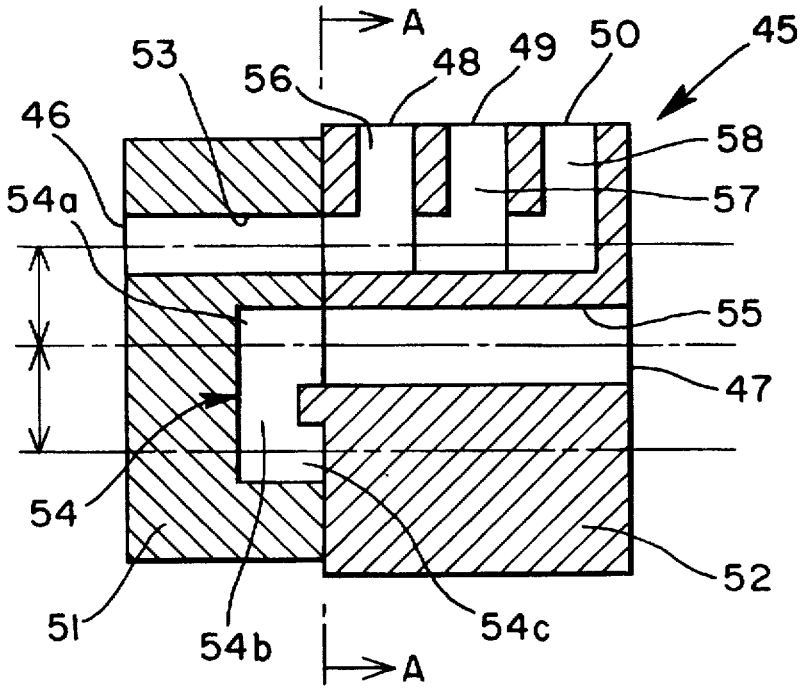
FIG. 4 is a schematic cross sectional view illustrating a constitution of a switching valve in a third embodiment according to the present invention.
Figure 5:
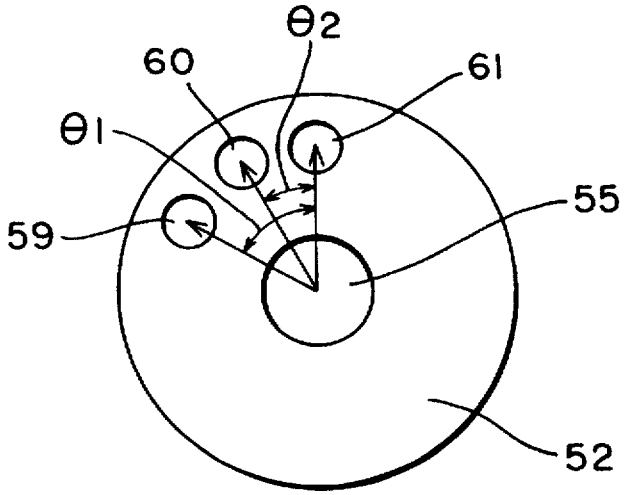
FIG. 5 is a cross sectional view for the switching valve taken along line A—A in FIG. 4.
Figure 6A:
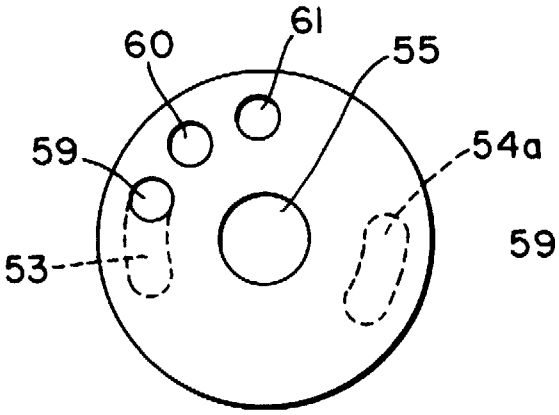
FIG. 6 is a view showing the switching valve at first position-sixth position in the third embodiment according to the present invention in which are shown a first position (a), a second position (b), a third position (c), a fourth position (d), a fifth position (e) and a sixth position (f)
Figure 6B:
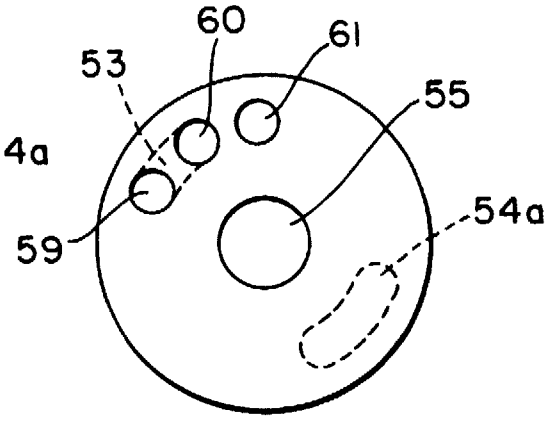
Figure 6C:
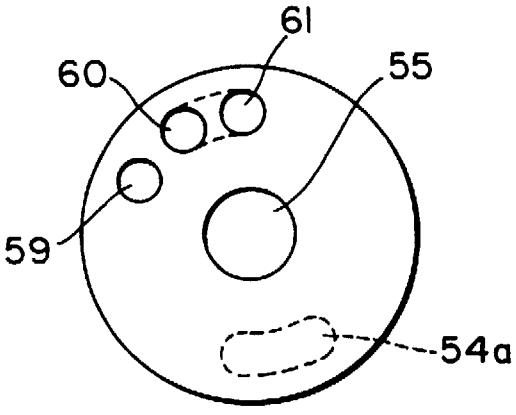
Figure 6D:
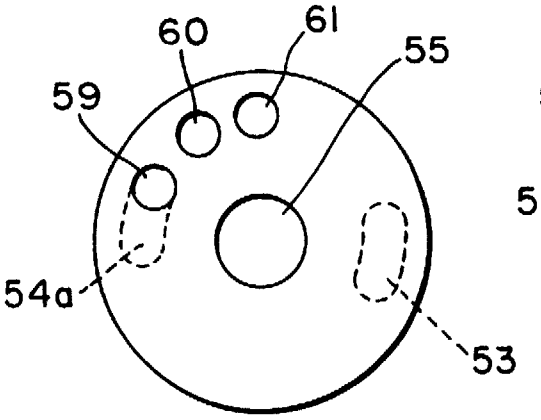
Figure 6E:
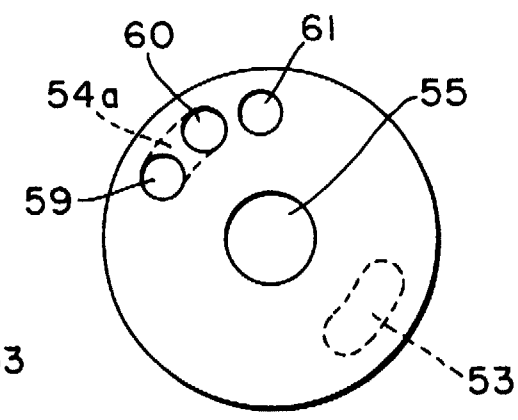
Figure 6F:
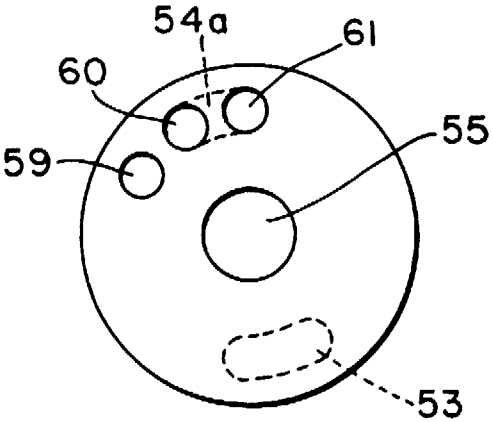

FIG. 4 and FIG. 5 show one embodiment of a concrete constitution of the switching valve 45 in the third embodiment. That is, in FIG. 4, the switching valve 45 has a rotary valve 51 and a valve seat 52. Both the rotary valve 51 and the valve seat 52 are formed into a cylindrical shape such that each of cylindrical axes is aligned. The valve seat 52 has the low pressure port 47 formed at a position including the cylindrical axis, and a low pressure gas introduction port 55 is formed from the low pressure port 47 to a surface facing the rotary valve 51. On the other hand, the rotary valve 51 has a communication tube 54 formed at a position facing the low pressure gas introduction port 55. Communication tube 54 has a first tube 54*a* extending in parallel with a position aligned with the low pressure gas introduction port, and having an opening at a position eccentric from the cylindrical central axis, and a second tube 54*b* for connecting the first tube 54*a* and the third tube 54*c*. The valve seat 52 has the first pulse tube-side port 48, the regenerator-side port 49 and the second pulse tube-side port 50 formed at the lateral side of the cylindrical shape. First pulse tube-side port 48 is in a communication state with a first opening portion 59 formed at a position facing the rotary valve 51 by the first introduction port 56, the second pulse tube-side port 50 is in communication with a second opening portion 60 formed at a position also facing the rotary valve 51 by a second introduction port 57 and a regenerator opening portion 61 formed at a position facing the rotary valve 51 by a regenerator-side introduction port 58. Further, the rotary valve 51 has the high pressure port 46 formed at a position eccentric from the cylindrical axis. High pressure introduction port 53 is formed from the high pressure port 46 in parallel with the cylindrical axis, penetrates the rotary valve 51 and opens to a surface facing the valve seat 52. At the surface facing the valve seat 52 of the rotary valve 51, the distance from the center of the first tube 54*a* to the center of the third tube 54*c* is equal to the distance from the center of the first tube 54*a* to the center of an opening facing the valve seat 52 of the high pressure gas introduction port 53. Further, as shown in FIG. 5, at the surface facing the rotary valve 51 of the valve sheet 52, the distance from the center of the low pressure gas introduction port 55 to the first opening portion 50, the distance from the center of the low pressure gas introduction port 55 to the second opening portion 60, and the distance from the center of the low pressure gas introduction port 55 to the regenerator opening portion 61 are made equal with each other, and the distance is equal to the distance from the center of the first tube 54*a* to the center of the third tube 54*b* in the rotary valve. Accordingly, when the rotary valve 51 is rotated with the cylindrical axis being aligned between the rotary valve 51 and the valve seat 52, the first pulse tube-side port 48, the regenerator-side port 49 and the second pulse tube-side port 50 disposed at the cylindrical lateral surface of the valve seat 52 are in communication with the high pressure port 46 of the rotary valve 51 or in communication with the low pressure port 47 of the valve seat 52.

Operation of the pulse tube refrigerator having the constitution described above is to be explained.

In switching the valve 45, when the rotary valve 51 rotates and the opening portion facing the valve seat 52 of the high pressure gas introduction port 53 is aligned with first opening portion formed at the surface facing the rotary valve 51 of the valve seat 52, a working gas at a high pressure exhausted from the compressor 40 passes through the high pressure tube 43 and enters the high pressure port 46 of the rotary valve 51, further flows from the high pressure gas introduction port 53 by way of the first opening portion 59, the first introduction port 56 and the first pulse tube-side port 48 into the first pulse tube 14, place the first pulse tube 14 a high pressure state. FIG. 6(*a*) shows a positional relationship between the rotary valve 51 and the rotary seat 52 on the opposing surface. The positional relationship shown in FIG. 6(*a*) corresponds to a first position in the present invention. Subsequently, when the rotary valve 51 further rotates and the opening portion of the high pressure gas introduction port 53 is aligned with the second opening portion 60, a working gas at a high pressure exhausted from the compressor 40 passes through the high pressure tube 43, enters into the high pressure port 46 of the rotary valve 51 and further from the high pressure gas introduction port 53 by way of the second opening portion 60, the second introduction port 57 and the second pulse tube-side port 50 and flows into the second pulse tube 17, to place the second pulse tube 17 in a high pressure state. FIG. 6(*b*) shows a positional relationship between the rotary valve 51 and the valve sheet 52 at the opposing surface. The positional relationship in FIG. 6(*b*) corresponds to the second position in the present invention. When the rotary valve 51 further rotates and the opening of the high pressure gas introduction port 53 is aligned with the refrigerator opening 61, a working gas at a high pressure exhausted from the compressor 40 passes through the high pressure tube 43, enters into the high pressure port 46 of the rotary valve 51 and, further, from the high pressure gas introduction port 53 by way of the refrigerator opening portion 61, the refrigerator introduction port 58 and the refrigerator-side port 49 enters into the first refrigerator 9 to place the first refrigerator 9 in a high pressure state. FIG. 6(*c*) shows a positional relationship between the rotary valve 51 and the valve seat 52 at the opposing surface. The positional relationship shown in FIG. 6(*c*) corresponds to a third position in the present invention. When the rotary valve 51 further rotates, the opening portion of the third tube 54*c* and the first opening portion 59 are now aligned among connection tube 54 of the rotary valve 51, in which a working gas at a high pressure in the first pulse tube 14 passes from the first pulse tube-side port 48 through the first pulse tube opening portion 59, flows by way of the communication tube 54 and the low pressure gas introduction port 55 into the low pressure tube 44 and is then fed back to the suction side 42 of the compressor 40. FIG. 6(*d*) shows a positional relationship between the rotary valve 51 and the valve seat 52. The positional relationship shown in FIG. 6(*d*) corresponds to a fourth position in the present invention. When the rotary valve 51 further rotates, the third tube 54*c* and the second opening portion 60 are aligned with each other. Then, a working gas at a high pressure in the second pulse tube 17 passes the second pulse tube-side port 50, flows by way of the second opening portion 60, the communication tube 54 and the low pressure gas introduction port 55 into the low pressure tube 44 and is fed back to the suction side 42 of the compressor 40. 11 FIG. 6(*e*) shows a positional relationship between the rotary valve 51 and the valve seat 52. The positional relationship shown in FIG. 6(*e*) corresponds to a fifth position in the present invention. When the rotary valve 51 further rotates, the third tube 54*c* and the regenerator opening portion 61 are aligned with each other. Then, a working gas at a high pressure in the first regenerator 9 passes the regenerator-side port 49, flows by way of the regenerator opening portion 61, the communication tube 54 and the low pressure gas introduction port 55 into the low pressure tube 44 and is fed back to the suction side 42 of the compressor 40. FIG. 6(*f*) shows a positional relationship between the rotary valve 51 and the valve seat 52. The positional relationship shown in FIG. 6(*e*) corresponds to a sixth position in the present invention.

One rotation of the rotary valve 54 corresponds to one cycle and refrigeration is generated in the first cold head 13 and the second cold head 16 by continuously rotating the rotary valve.

Figure 7:
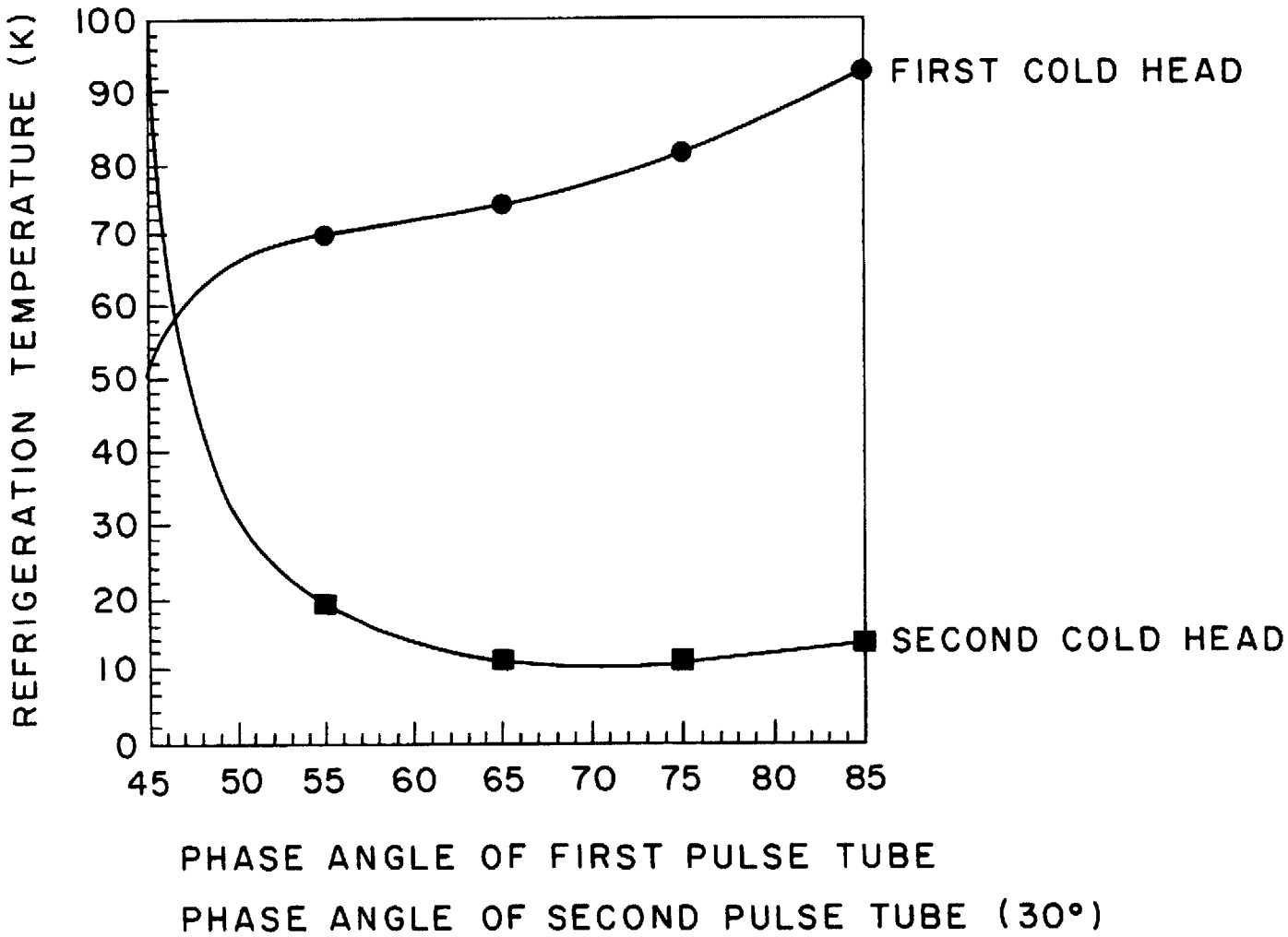
FIG. 7 is a graph showing the change of the refrigeration temperature in the first and second cold heads when the phase angle of the first pulse tube-side phase shifter is changed while the phase angle of the second pulse tube-side phase shifter is fixed in the first to third embodiments according to the present invention.
Figure 8:
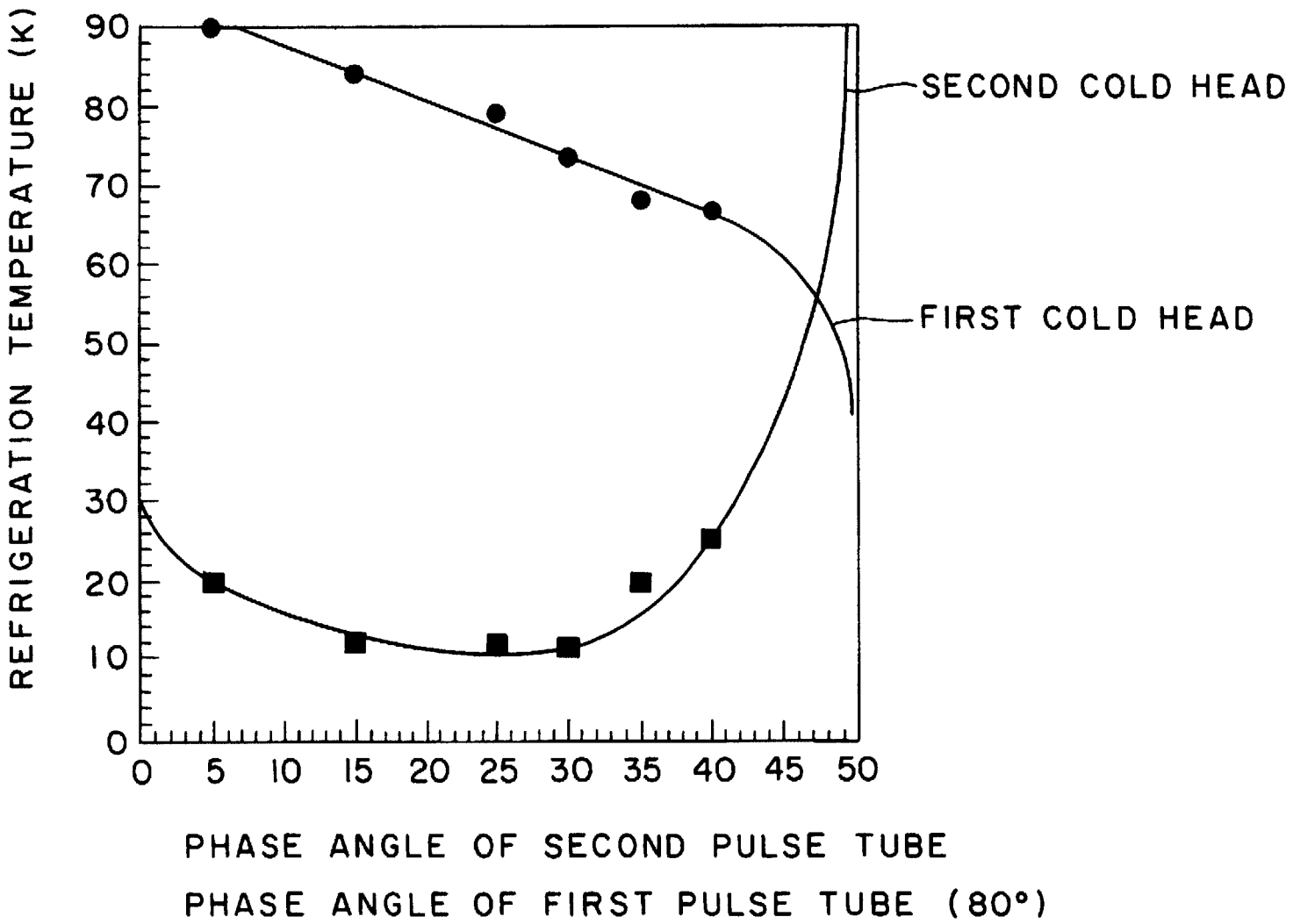
FIG. 8 is a graph showing the change of the refrigeration temperature in the first and second cold heads when the phase angle of the second pulse tube-side phase shifter is changed while the phase angle of the first pulse tube-side phase shifter is fixed in the first to third embodiments according to the present invention.

FIG. 7 and FIG. 8 are graphs for the result of measurement of refrigeration temperature in each of the cold heads in a pulse tube refrigerator in the third embodiment according to the present invention, by changing the phase angle for the high/low pressure switching operation timing of the first pulse tube-side port and the second pulse tube-side port to the refrigerator-side port. When the pulse tube opening portion disposed to the valve seat 52 shown in FIG. 5 is displaced by a predetermined angle relative to the refrigerator opening, the predetermined angle constitutes the phase angle of the operation timing in the pulse tube-side port (in FIG. 5, angle $\theta_1$ is the phase angle of the operation timing of the first pulse tube-side port relative to the refrigerator-side port, and $\theta_2$ is the phase angle of the operation timing of the second pulse tube-side port relative to the refrigerator-side port). $\theta_1$ corresponds to the phase angle of the operation timing between the first position and the third position and the phase angle of the operation timing between the fourth position and the sixth position, while $\theta_2$ corresponds to the phase angle of the operation timing between the second position and the third position and the phase angle of the operation timing between the fifth position and the sixth position. In FIG. 7, $\theta_2$ is fixed while $\theta_1$ is varied and, in FIG. 8, $\theta_1$ is fixed while $\theta_2$ is varied. The phase angle is shown as a positive number in the drawing, but this shows an absolute valve of the phase angle difference of the high/low pressure switching timing in each of the pulse tube-side ports when the phase angle of the high/low pressure switching timing is made 0 in the regenerator-side port. Actually, since each of the pulse tubes shows high/low pressure switching change at a timing faster than the regenerator, a negative number is taken. It can be seen from the above at first in FIG. 7 that if $\theta_1$ is not more than 50°, the refrigeration temperature in the second cold head is relatively low, whereas the second cold head temperature rises abruptly when it is below 50°. Further, it has been confirmed that the refrigeration temperature in the first cold head is elevated if $\theta_1$ is not less than 85°. Further, it has been confirmed in FIG. 8 that the refrigeration temperature in the second cold head is elevated if $\theta_2$ is not less than 35° C. Further, it has been confirmed that the refrigeration temperature in both of the second cold head and the second cold head is raised if the value is not more than 15°. Accordingly, it can be seen that a satisfactory refrigeration performance can be obtained within the angle range of the phase angle ($\theta_1$) of the first pulse tube-side port relative to the refrigerator-side port is from 50° to 85°, and the phase angle ($\theta_2$) of the first pulse-tube side port relative to the refrigerator-side port of 15° to 35°.

As described above, in FIG. 7, the refrigeration temperature of the first cold head and the second cold head is measured while fixing the phase angle ($\theta_2$) of the switching operation timing of the second pulse tube-side port relative to the refrigerator-side port. FIG. 8 shows the refrigeration temperature of the first cold head and the second cold head measured while fixing the phase angle ($\theta_1$) of the switching operation timing of the first pulse tube-side port relative to the refrigerator-side port to 80°. Then, the refrigeration temperature of the cold heads was measured while variously changing $\theta_1$ and $\theta_2$ to search the range for the phase angle. Table 1 shows test conditions therefor and the refrigeration temperature in each of the cold heads.

TABLE 1

| $\theta_1$ (°) | $\theta_2$ (°) | $T_1$ (K) | $T_2$ (K) |
|---|---|---|---|
| 95 | 60 | 62.9 | 12.1 |
| 105 | 70 | 49.5 | 11.0 |
| 110 | 75 | 50.0 | 11.4 |
| 115 | 80 | 56.3 | 12.8 |

In table 1, $\theta_1$ is a phase angle of the operation timing of the first pulse tube-side port relative to the regenerator-side port, $\theta_2$ is a phase angle of the operation timing of the second pulse tube-side port relative to the regenerator-side port, and $T_1$ is a temperature reached in the first cold head and $T_2$ is a temperature reached in the second cold head.

From Table 1, it has been confirmed that the refrigeration temperature in the first cold head reached 49K–63K, while the refrigeration temperature in the second cold head reached 11K–13K within the range of $\theta_1$ from 95° to 115° when $\theta_2$ is from 60° to 80°. The temperature of 11K–13K reached in the second cold head is a satisfactory range for the temperature reached also in view of FIG. 7 and FIG. 8. Accordingly, it can be seen from Table 1 that a satisfactory refrigeration performance is shown also within the angular range for the phase angle $\theta_1$ of the switching operation timing of the first pulse tube-side port from 95° to 115° and phase angle $\theta_2$ of the switching operation timing of the second pulse tube-side port from 60° to 80°. Although not shown in Table 1, it has been found that the tube diameter of the pulse tube also constitutes a factor giving an effect on the range for the phase angle of the valve switching timing capable of obtaining a satisfactory refrigeration performance. It has generally been confirmed that as the pulse tube diameter is increased, it shifts in the direction of increasing the phase angle of the valve switching timing capable of obtaining a satisfactory refrigeration performance.

As described above, the optimum phase angle of the valve switching operation timing for improving the refrigeration performance obtained experimentally from FIG. 7, FIG. 8 and Table 1 is from −50° to −115° for the phase angle ($\theta_1$) of the switching operation timing of the first pulse tube-side port 48 relative to the regenerator-side port 49, and −15° to −80° for the phase angle ($\theta_2$) of the switching operation timing of the second pulse tube-side port 50 relative to the regenerator-side port 49. As described previously, the phase angle of the switching operation timing changes depending on the tube diameter of the pulse tube and other refrigeration conditions, it is apparent that the refrigeration performance is improved also within a range of −50° to −120° for $\theta_1$ and −15° to −90° for $\theta_2$ by changing them.

In the two stage type pulse tube refrigerator, in order to examine how the refrigeration performance varies theoretically in the first and the second cold heads, a simulation is conducted by numerical value calculation to determine the relationship between the phase angle of the switching timing of the first and the second pulse tube-side ports, and the refrigeration power of each of the cold heads. In this case, the refrigeration temperature is determined as the maximum value of a required amount of electric power of the heater (unit:W) when the first cold head 13 and second cold head 16 are heated by a heater and where the temperature in the cold heads does not raise but can be maintained at a constant temperature.

Figure 9:
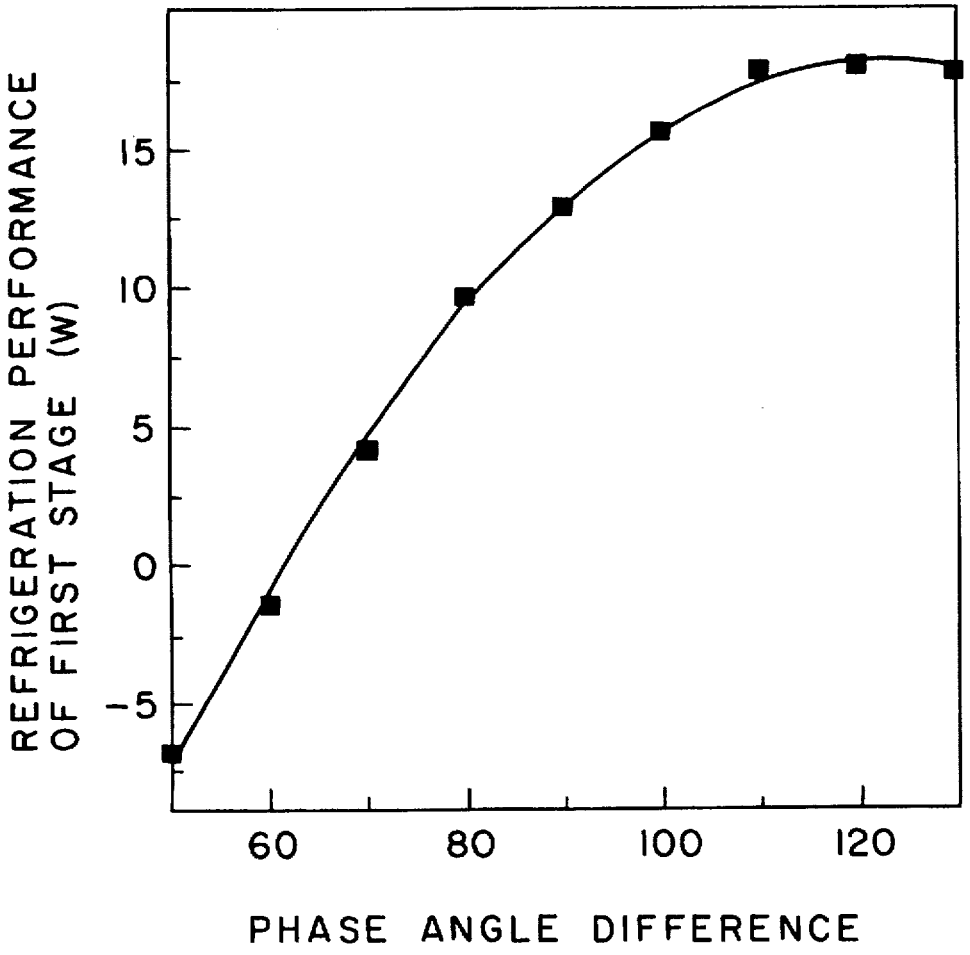
FIG. 9 is a graph illustrating the result of a numerical value calculation simulation for the refrigeration performance in the two stage type pulse tube refrigerator according to the present invention in which the abscissa shows the phase angle at the first pulse tube-side port relative to the first regenerator-side port, and the ordinate shows the refrigeration performance of the first cold head.

FIG. 9 is a graph showing a relationship between the phase angle of the switching operation timing in the pulse tube-side port and the refrigeration performance of the first cold head. It has been confirmed from the graph that the refrigeration power is high near the phase angle from 100° to 130° of the switching operation timing in the first pulse tube-side port.

Figure 10:
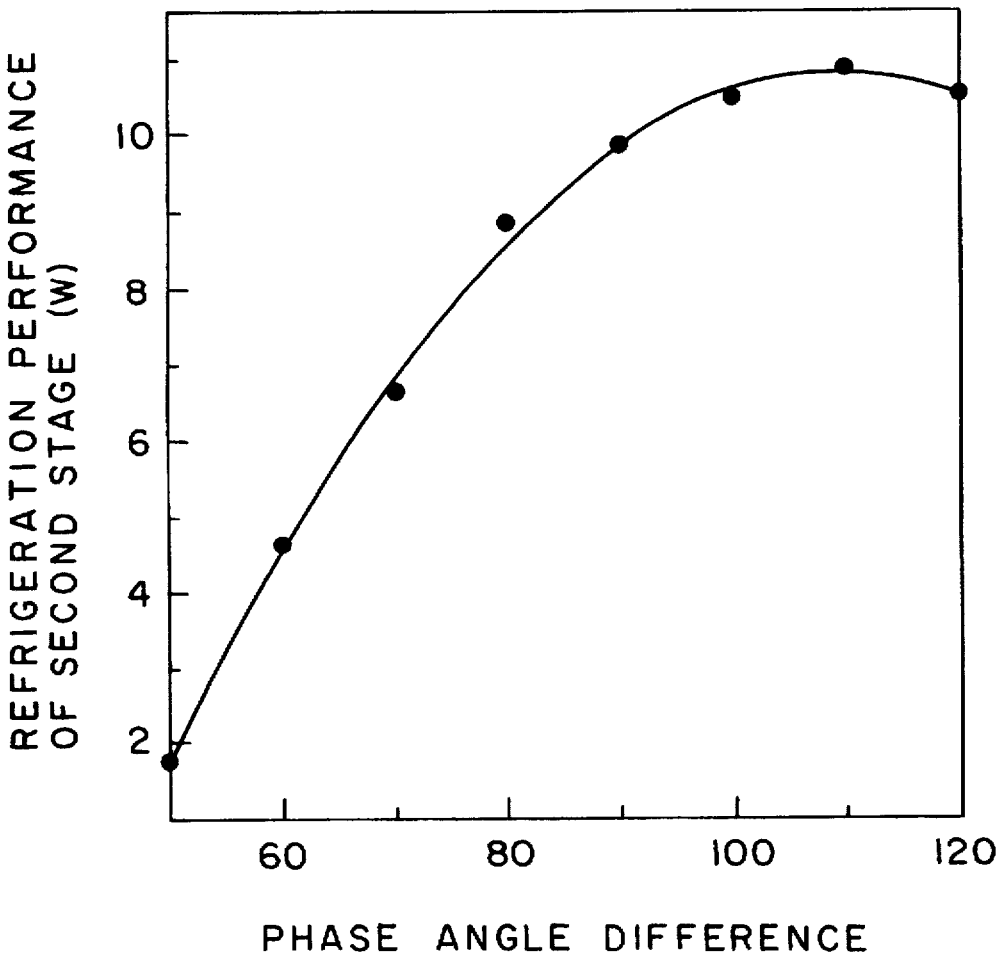
FIG. 10 is a graph illustrating the result of a numerical value calculation simulation for the refrigeration performance in the two stage type pulse tube refrigerator according to the present invention in which the abscissa shows the phase angle at the second pulse tube-side port relative to the first regenerator-side port, and the ordinate shows the refrigeration performance of the second cold head.
Figure 11:
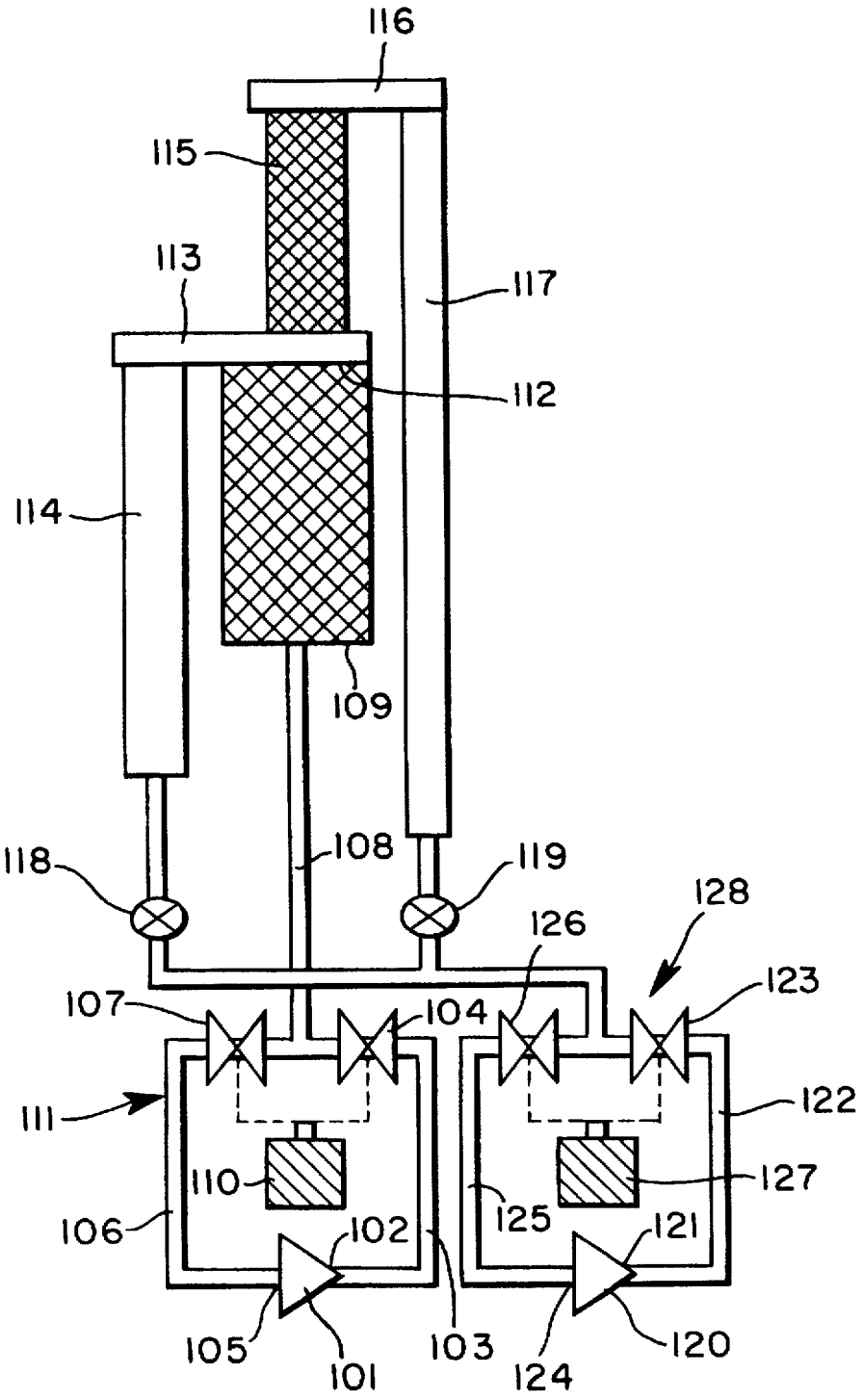
FIG. 11 is an entire view for the two stage type pulse tube refrigerator in the prior art.

Further, FIG. 10 is a graph showing a relationship between the phase angle of the switching operation timing in the pulse tube-side port and the refrigeration performance of the second cold head. It has been confirmed from the graph that the refrigeration power is high near the phase angle from 90° to 120° of the switching operation timing in the second pulse tube-side port.

Although an explanation has been made in the first to third embodiments with respect to the two stage type pulse tube refrigerator, the technique of the present invention is not necessarily limited at all to the two stage-type pulse tube refrigerator and it is applicable also to multi stage pulse tube refrigerators such as three stage or four stage so long as they do not depart from the scope of the present invention.

The following effect can be obtained by the first aspect of the present invention.

In a multistage pulse tube refrigerator in which a plurality of refrigerators and a plurality of cold heads that are the same number as the refrigerators are alternately connected in series, a pulse tube and a phase shifter are connected respectively to one end of the cold heads and each of the phase shifters is controlled independently. Thus, the phase angle in each of the cold heads can be set optionally to obtain a pulse tube refrigerator with improved refrigeration efficiency.

The following effect can be obtained by the second aspect of the present invention.

In the two stage type pulse tube refrigerator, the first pulse tube-side phase shifter is connected to the first pulse tube, while the second pulse tube-side phase shifter is connected to the second pulse tube, and each of the phase shifters is controlled independently. Thus, the phase angle in the first and the second cold heads can be set optionally to obtain a pulse tube refrigerator improved in refrigeration efficiency.

The following effect can be obtained by the third aspect of the present invention.

In the multistage pulse tube refrigerator in the second aspect, the pulse tube refrigerator is operated within the range of the phase angle of the first pulse tube relative to the refrigerator from −50° to −120°, and from −15° to −90° for the phase angle of the second pulse tube relative to the refrigerator. Thus, an operation with extremely high refrigeration efficiency in each of the first cold head and the second cold head is possible and the refrigeration temperature in the second cold head can reach an extremely low temperature.

The following effect can be obtained by the fourth aspect of the present invention.

The two stage pulse tube refrigerator was adapted to such a pipeline constitution that the pressure change of the working gas to be supplied by a refrigerator from one pressure oscillation generator, the phase control on the first pulse tube and the phase control on the second pulse tube can be controlled independently of each other. Also with such a constitution, the phase control on the first pulse tube, and the phase control on the second pulse tube can be changed independently of each other, so that the phase angle of the working gas in the first cold head and the second cold head can be set optionally, which can improve the refrigeration efficiency and an economical pulse tube refrigerator can be obtained at a reduced cost since it requires only one pressure oscillation generator.

The following effect can be obtained by the fifth aspect of the present invention.

In the multistage pulse tube refrigerator in the fourth aspect of the present invention, the switching timing was displaced by providing a phase difference from −50° to −120° for the switching timing of the first pulse tube-side valve control device relative to the high/low pressure switching timing of the refrigerator, and from −15° to −90° of the switching timing of the second pulse tube-side valve control device relative to the high/low pressure switching timing of the regenerator-side control device. Thus, operation at a high refrigeration efficiency is always possible in the first cold head and the second cold head respectively and, further, the refrigeration temperature in the second cold head can reach an extremely low temperature.

The following effect can be obtained by the sixth aspect of the present invention.

In the two stage pulse tube refrigerator, the first refrigerator, the first pulse tube and the second pulse tube are connected to the switching valve and the switching valve is constituted such that the high pressure and the low pressure sides of the pressure oscillation generator and the first regenerator, the first pulse tube and the second pulse tube are in communication independently of each other. That is, the switching valve communicates the high pressure side of the oscillation generator and the first pulse tube at the first position, communicates the high pressure side of the pressure oscillation generator and the second pulse tube at the second position, communicates the high pressure side of the pressure oscillation generator and the first regenerator at the third position, communicates the low pressure side of the pressure oscillation generator and the first pulse tube at the fourth position, communicates the low pressure side of the pressure oscillation generator at the fifth position, and communicates the low pressure side of the pressure oscillation generator and the first regenerator at the sixth position. Thus, the phase angle in the first and the second cold heads can be set optionally to improve the refrigeration efficiency, and since the pressure change of the working gas and the phase control of the working gas are made into a unit structure, a multistage pulse stage refrigerator which is compact and simple in the constitution can be attained.

The following effect can be obtained by the seventh aspect of the present invention.

High/low pressure switching to the first regenerator, the first pulse tube and the second pulse tube has been attained by constituting the switching valve in the fourth aspect in the present invention with the rotary valve and the valve seat and rotating the rotary valve. Thus, the phase angle in the first and the second cold heads can be set optionally to improve the refrigeration efficiency, and since the communication position between the first output port, the second output port or the third output port disposed to the valve sheet and the pressure oscillation generator can be changed when changing the phase angle for each of the pulse tubes, the phase angle can be changed simply.

The following effect can be obtained by the eighth aspect of the present invention.

In the two stage pulse tube refrigerator of the sixth or seventh aspect of the present invention, the phase angle of the operation timing between the first position and the third position, and the phase angle of the operation timing between the fourth position and the sixth position were set to −50°to −120°, while the phase angle of the operation timing between the second position and the third position, and the phase angle of the operation timing between the fifth position and the sixth position were set to −15° to −90°.

Thus, operation with an extremely high refrigeration efficiency in each of the first cold head and the second cold head is possible and the refrigeration temperature in the second cold head can reach an extremely low temperature.

What is claimed is:

1. A multistage type pulse tube refrigerator comprising:

a regenerator-side pressure oscillation generator, a first regenerator connected to the regenerator-side pressure oscillation generator, a first cold head connected to a low temperature end of the first regenerator, a second regenerator connected to the first cold head;

a second cold head connected to the second regenerator;

a first pulse tube-side phase shifter;

a second pulse tube-side phase shifter;

a first pulse tube having one end connected to the first cold head and another end connected to the first pulse tube-side phase shifter by way of a first flow regulating mechanism;

a second pulse tube having one end connected to the second cold head and another end connected to the second pulse tube-side phase shifter by way of a second flow regulating mechanism; and an operation timing for each of the first pulse tube-side phase shifter and the second pulse tube-side phase shifter being controlled independently, and the phase angle with respect to the operation timing of the first pulse tube-side phase shifter relative to the regenerator-side pressure oscillation generator being from −50° to −120°, the phase angle with respect to the operation timing of the second pulse tube-side phase shifter relative to the regenerator-side pressure oscillation generator being from −15° to −90°, the operation timing of the first pulse tube-side phase shifter being earlier than the operation timing of the second pulse tube-side phase shifter, and the phase angle difference between the operation timing of the first pulse tube-side phase shifter and the operation timing of the second pulse tube-side phase shifter being from 20° to 60°.

2. A multistage type pulse tube refrigerator as defined in claim 1, wherein the phase angle with respect to the operation timing of the second pulse tube-side phase shifter relative to the regenerator-side pressure oscillation generator is from −15° to −90°.

3. A multistage type pulse tube refrigerator comprising:

a regenerator-side pressure oscillation generator, a first regenerator connected to the regenerator-side pressure oscillation generator;

a first cold head connected to a low temperature end of the first regenerator;

a second regenerator connected to the first cold head;

a second cold head connected to the second regenerator;

a first pulse tube-side phase shifter;

a first pulse tube having one end connected to the first cold head and another end connected to the first pulse tube-side phase shifter by way of a first flow regulating mechanism;

a second pulse tube-side phase shifter;

a second pulse tube having one and connected to the second cold head and another end connected to the second pulse tube-side phase shifter by way of a second flow regulating mechanism; and an operation timing for each of the first pulse tube-side phase shifter and the second pulse tube-side phase being controlled independently, and the phase angle with respect to the operation timing of the second pulse tube-side phase shifter relative to the regenerator-side pressure oscillation generator being from −15° to −90°.

4. A multistage type pulse tube refrigerator as defined in claim 3, wherein the phase angle with respect to the operation timing of the first pulse tube-side phase shifter relative to the regenerator-side pressure oscillation generator is from −50° to −120°.

5. A multistage type pulse tube refrigerator comprising:

a compressor having a discharge port and a sucking port for a working gas;

a regenerator-side high pressure communication tube connected to the discharge port of the compressor;

a high pressure opening/closing valve for regenerator disposed at a top end of the regenerator-side high pressure communication tube;

a regenerator-side low pressure communication tube connected to the suction port of the compressor;

a low pressure opening/closing valve for regenerator disposed at a top end of the regenerator-side low pressure communication tube;

a first regenerator;

a regenerator-side conduit for connecting the high pressure opening/closing valve for regenerator and the low pressure opening/closing valve for regenerator to the first regenerator;

a regenerator-side valve control device for controlling opening/closing of the high pressure opening/closing valve for regenerator and the low pressure opening/closing valve for regenerator in an alternating manner;

a first pulse tube-side high pressure communication tube connected to an intermediate point of the regenerator-side high pressure communication tube;

a high pressure opening/closing valve for first pulse tube disposed at a top end of the first pulse tube-side high pressure communication tube;

a first pulse tube-side low pressure communication tube connected to an intermediate point of the regenerator-side low pressure communication tube;

a low pressure opening/closing valve for first pulse tube disposed to at a top end of the first pulse tube-side low pressure communication tube;

a first pulse tube-side conduit for connecting the high pressure opening/closing valve for first pulse tube and the low pressure opening/closing valve for first pulse tube with a first pulse tube;

a first pulse tube-side valve control device for controlling opening/closing of the high pressure opening/closing valve for first pulse tube and the low pressure opening/closing valve for first pulse tube in an alternating manner;

a second pulse tube-side high pressure communication tube connected to an intermediate point of the regenerator-side high pressure communication tube;

a high pressure opening/closing valve for second pulse tube disposed at a top end of the second pulse tube-side high pressure communication tube;

a second pulse tube-side low pressure communication tube connected to an intermediate point of the first tube-side low pressure communication tube;

a low pressure opening/closing valve for second pulse tube disposed at a top end of the second pulse tube-side low pressure communication tube;

a second pulse tube-side conduit for connecting the high pressure opening/closing valve for second pulse tube and the low pressure opening/closing valve for second pulse tube with a second pulse tube;

a second pulse tube-side valve control device for controlling opening/closing of the high pressure opening/closing valve for second pulse tube and the low pressure opening/closing valve for second pulse tube in an alternating manner;

a first cold head having one end connected to the first refrigerator and an another end connected to the first pulse tube;

a second regenerator having one end connected to the first cold head;

a second cold head having one end connected to the second regenerator and another end connected to the second pulse tube;

high/low pressure switching timing of the regenerator-side valve control device, the first pulse tube-side valve control device, and the second pulse tube-side valve control device being controlled independently; and the high/low pressure switching timing for the first pulse tube-side valve control device having a phase angle of from −50° to −120° relative to the high/low pressure switching timing for the regenerator-side valve control device, and the high/low pressure switching timing for the second pulse tube-side valve control device having a phase angle of from −15° to −90° relative to the high/low pressure switching timing of the regenerator-side valve control device.

6. A multistage type pulse tube refrigerator comprising:

a compressor having a discharge port and a sucking port for a working gas;

a switching valve having a high pressure input port in communication with the discharge port of the pressure oscillation generator, a low pressure input port in communication with the suction port of said pressure oscillation generator, a first output port, a second output port and a third output port;

a first cold head;

a first regenerator having one end in communication with the third output of said switching valve and another end in communication with the first cold head;

a first pulse tube having one end in communication with the first cold head and another end in communication with said first output port of the switching valve by way of a flow regulating mechanism;

a second cold head;

a second regenerator having one end in communication with the first cold head and another end in communication with the second cold head; and a second pulse tube having one end in communication with said second cold head and another end in communication with said second output port of the switching valve by way of a second flow regulating mechanism;

the switching valve being operationally positionable in a first position for communicating said first output port and said high pressure input port, a second position for communicating said second output port and said high pressure input port, a third position for communicating said third output port and said high pressure input port, a fourth position for communicating said first output port and said low pressure input port, a fifth position for communicating said second output port and said low pressure input port, and a sixth position for communicating said third output port and said low pressure input port;

the phase angle between the first position and the third position being from −50° to −120°, the phase angle between the second position and the third position being from −15° to −90°, the phase angle between the fourth position and the sixth position being from −50° to −120°, and the phase angle between the fifth position and the sixth position being from −50° to −120°.

7. A multistage type pulse tube refrigerator as defined in claim 6, wherein the switching valve comprises a rotatable rotary valve and a valve seat opposed to said rotary valve, the valve seat having the first output port, the second output port, the third output port, and the low pressure input port, the rotary valve comprising the high pressure input port and a communication tube having one end always in communication with said low pressure input port, said switching valve communicating said high pressure input port with said first output port at the first position, communicating said high pressure input port with the second output port at the second position, communicating said high pressure input port with said third output port at the third position, communicating an opposite end of the communication tube with the first output port at the fourth position, communicating the opposite end of the communication tube with the second output port at the fifth position, and communicating the opposite end of the communication tube with the third output port at the sixth position.

* * * * *